US009707765B2

(12) United States Patent
Williams et al.

(10) Patent No.: US 9,707,765 B2
(45) Date of Patent: Jul. 18, 2017

(54) INHIBITING SEDIMENT FORMATION IN A MICR INK TANK

(71) Applicant: Xerox Corporation, Norwalk, CT (US)

(72) Inventors: James E. Williams, Penfield, NY (US); John Robert Uchal, Webster, NY (US); Paul F. Sawicki, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/949,493

(22) Filed: Nov. 23, 2015

(65) Prior Publication Data

US 2017/0144444 A1 May 25, 2017

(51) Int. Cl.
*B41J 2/175* (2006.01)

(52) U.S. Cl.
CPC ..... *B41J 2/175* (2013.01)

(58) Field of Classification Search
CPC ..... B41J 2/18; B41M 3/14
See application file for complete search history.

(56) References Cited

U.S. PATENT DOCUMENTS 4,812,856 A * 3/1989 Wallace ..... B41J 2/175 118/610
5,451,987 A * 9/1995 Perrin ..... B41J 2/195 347/6
6,767,396 B2 * 7/2004 McElligott ..... C09D 11/322 106/31.65
7,293,849 B2 * 11/2007 Tani ..... B41J 2/17503 347/21
8,511,794 B1 * 8/2013 Thompson ..... B41J 2/16517 347/33
9,421,785 B1 * 8/2016 Vankouwenberg .. B41J 2/17566
(Continued)

FOREIGN PATENT DOCUMENTS

JP 2002337360 A * 11/2002

OTHER PUBLICATIONS

Machine Translation Shinada, Satoshi, JP2002-337360; https://dossier1.j-platpat.inpit.go.jp/tri/all/odse/ODSE_GM101_Top.action; Retrieved Jun. 20, 2016.*

(Continued)

*Primary Examiner* — Stephen Meier
*Assistant Examiner* — John P Zimmermann
(74) *Attorney, Agent, or Firm* — Philip E. Blair; Fleit Gibbons Gutman Bongini & Bianco P.L.

(57) ABSTRACT

What is disclosed is an apparatus and method for inhibiting the formation of sediment in an ink tank of a MICR inkjet printer. In one embodiment, the present apparatus comprises an ink tank containing MICR ink and an electromagnet which resides in a chamber located on, near, or inside the ink tank. Activation of the electromagnet causes the particles to be attracted to the electromagnet's magnetic field such that the particles are lifted off a bottom of the tank to inhibit sediment formation thereon. The electromagnet can be activated in response to the MICR inkjet printer having been turned OFF. A sensor may further be employed to activate the electromagnet in response to one of: sediment in the ink tank having reached a pre-determined level; a flow-rate of liquid ink through the tank having fallen below a threshold level, sediment levels, or a pressure inside the tank.

22 Claims, 6 Drawing Sheets

(56) References Cited

U.S. PATENT DOCUMENTS

| | | | | |
|---|---|---|---|---|
| 2008/0210160 | A1* | 9/2008 | Namekawa | B41J 2/175<br>118/300 |
| 2011/0025790 | A1* | 2/2011 | Serizawa | B41J 2/17509<br>347/86 |
| 2012/0127243 | A1* | 5/2012 | Kumagai | B41J 2/18<br>347/85 |
| 2012/0236064 | A1* | 9/2012 | Iftime | C09D 11/36<br>347/20 |
| 2013/0307909 | A1* | 11/2013 | Adiletta | B41J 2/17593<br>347/88 |
| 2014/0202960 | A1* | 7/2014 | Nishijima | B03C 1/032<br>210/695 |

OTHER PUBLICATIONS

Xerox, "Generic MICR Fundamentals Guide", Jan. 2003, pp. 1-172.*

* cited by examiner

INHIBITING SEDIMENT FORMATION IN A MICR INK TANK

TECHNICAL FIELD

The present invention is directed to a method and apparatus for inhibiting sediment from forming in an ink tank containing a ferrofluid of particles in a Magnetic Ink Character Recognition (MICR) inkjet printer.

BACKGROUND

Magnetic Ink Character Recognition (MICR) printing is most frequently used for checks, warrants, drafts, negotiable instruments, rebate coupons, invoices, statements, remittances, control documents, document security, to name a few. MICR ink is a ferrofluid of metallic particles. When the MICR system is not being used, ink sedimentation forms in the ink tank which may cause the system to clog. Clogging in the ink tank is a primary concern and can be costly to repair. The present invention is specifically directed to inhibiting the formation of sediment in an ink tank of a MICR inkjet printer.

BRIEF SUMMARY

In one embodiment, the apparatus of the present invention comprises an ink tank containing a liquid MICR ink substantially comprising a ferrofluid of particles and a rotatable magnet residing in a chamber located on, near, or inside the ink tank. A rotation of the magnet causes the magnet's field lines to stir the particles of the ferrofluid to inhibit sediment formation inside the ink tank. A rotation of the magnet can be induced by an electric current, by a rotation of a magnetic field of another magnet in proximity thereto, a motor with a rotating shaft connected to the magnet, or manually by a user. The magnet's rotation is initiated in response to the MICR inkjet printer having been turned OFF. When the MICR inkjet printer is turned back ON, the rotation of the magnet ceases. A controller may be used to control a speed of the magnet's rotation. A sensor may be employed to signal the controller in response to sediment in the ink tank having reached a pre-determined level, a flow-rate of liquid ink through the tank having fallen below a threshold level, and a pressure inside the tank having reached a threshold level. In another embodiment, an electromagnet resides in a chamber located on, near, or inside the ink tank. Activation of the electromagnet causes the particles to be attracted to the electromagnet's magnetic field such that the particles are lifted off a bottom of the tank to inhibit sediment formation. The electromagnet may be rotatable. Features and advantages of the present invention will become readily apparent from the following detailed description and accompanying drawings.

BRIEF DESCRIPTION OF THE DRAWINGS

The foregoing and other features and advantages of the subject matter disclosed herein will be made apparent from the following detailed description taken in conjunction with the accompanying drawings, in which.

DETAILED DESCRIPTION

What is disclosed is a system and method for inhibiting the formation of sediment in an ink tank of a Magnetic Ink Character Recognition (MICR) inkjet printer device. It should be appreciated that one of ordinary skill in this art would be readily familiar with various aspects of print devices utilizing inkjet technology as well as liquid MICR inks and ink tanks, to which the teachings hereof are directed.

A "Magnetic Ink Character Recognition (MICR)" is a technology used mainly by the financial/banking industry to facilitate the processing and clearance of checks and other financial documents. MICR encoding can be seen at the bottom of a check and other vouchers and may include a routing number, account number, and the like. This technology allows MICR readers to read the printed characters directly into a data-collection device without the need for a user intervention. Unlike barcodes, MICR characters can be read by humans. The E-13B font set (numbers & symbols) has been adopted as an international standard. For more information about MICR technology, the reader is directed to: Xerox Publication No. 701P22140, entitled: "*Generic MICR Fundamentals Guide*", (January 2003).

A "MICR inkjet printer" is an inkjet printer, as is generally understood, which operates by propelling variably-sized droplets of liquid ink (often mixed with a colorant) onto a media substrate. The output print is formed by the visual integration of the droplets on the paper. MICR inkjet systems operate no differently from an identical non-MICR inkjet system. Example MICR inkjet printers available in different streams of commerce include variants of the Xerox CiPress™ Production Inkjet Systems which utilize an aqueous inkjet module as an additional print station to jet MICR ink onto a media.

"MICR Ink" is a ferrofluid which contains very small particles (typically iron oxide) suspended in an aqueous solution. The ferrofluid may further contain a surfactant and a colorant. Characters printed with MICR inks have the property that they can be reliably read by a magnetic reader in a manner not too dissimilar to a magnetic tape reader and can even be reliably read if they have been overprinted or obscured by markings such as a cancellation stamp, a signature, scribbling, and the like. The error rate for a machine reading characters printed with MICR ink on a typical bank check is about 1 per 100,000 characters. MICR ink can be printed on most paper, although Xerox recommends a 90 gsm paper with a Sheffield smoothness of 80-150 and a 60% minimum reflectance. (See, Chapter 3, of the aforementioned Xerox Publication entitled: "*Generic MICR Fundamentals Guide*").

"Metallic particles", or simply "particles" is intended to refer to any sized particle of any chemical composition within the ferrofluid which facilitates the MICR ink's intended purpose. As such, the appended claims are not to be viewed as being limited to particles of a particular size, shape, or composition.

Figure 1:
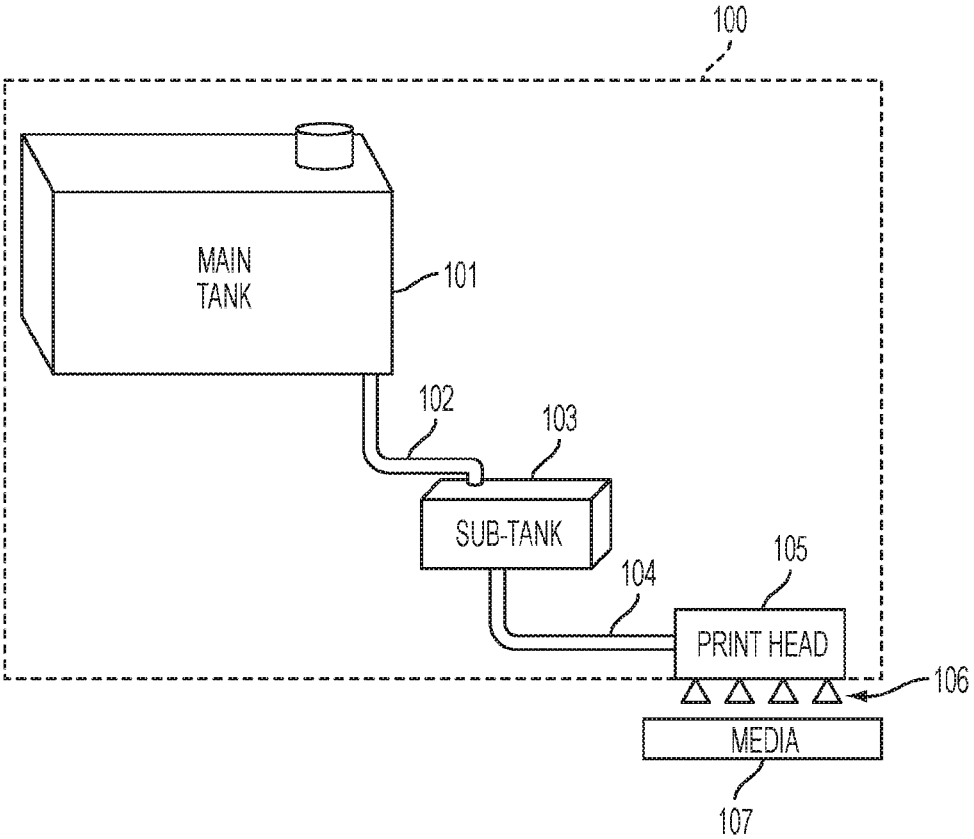
FIG. 1 shown one example embodiment of MICR inkjet printer to illustrate the relative relationship between the main tank, sub-tank, and printhead.

A "tank" refers to either the main ink tank or the smaller-sized ink sub-tank into which MICR ink is gravity fed (or pressure fed) via a feed-line or tube from the main ink tank. The ink in the sub-tank is transferred on-demand to one or more inkjet printheads which propel the ink onto the media. FIG. 1 serves to illustrate certain aspects of one generic embodiment of a MICR inkjet printer 100. Main tank 101 provides MICR ink to sub-tank 103 via feed-line 102. The MICR ink is then piped (generally at 104) to an inkjet printhead 105 which, in turns, propels the ink through a plurality of jets (collectively at 106) onto a media substrate 107. The present invention is directed to inhibiting the formation of sediment in the ink sub-tank using an electromagnet or a rotatable magnet.

An "electromagnet" is a type of magnet where the magnetic field is produced by an electric current. As is widely understood, electromagnets typically consist of a plurality of closely spaced turns of wire wound around a ferromagnetic core. As the electric current passes through the wound wire, a magnetic field is generated. Unlike a permanent magnet, an electromagnet requires a continuous supply of electricity to maintain the magnetic field. One advantage of an electromagnet is that the magnetic field can be changed by regulating the current.

"Activating the electromagnet" means applying an electric current to the electromagnet sufficient to produce and maintain the desired magnetic field generated thereby. Activating the electromagnetic causes the particles in the ferrofluid to be attracted to the magnetic field. The electromagnet can be activated in response to the MICR inkjet printer having been turned OFF with the electromagnet being de-activated when the MICR inkjet printer is turned ON. In other embodiments, the electromagnet is activated when the MICR inkjet printer has been idle for a pre-defined amount of time. The electromagnet can then be de-activated at a point prior to the print job being run. The electromagnet can be activated by a sensor signaling that sediment in the ink sub-tank has reached a pre-determined level. The electromagnet can then be de-activated when the level of sediment has been reduced or eliminated, or after the passage of a pre-determined amount of time. The electromagnet can be activated by a sensor signaling that a flow-rate of liquid ink through the sub-tank is at or below a threshold level of acceptability. The electromagnet can then be de-activated when the flow rate has been increased or has otherwise returned to acceptable levels, or after the passage of a pre-determined amount of time. In those MICR inkjet printers where the MICR ink is under pressure in the sub-tank, the electromagnet can be activated by a sensor signaling that the pressure inside the tank has reached or exceeded a threshold level of acceptability. The electromagnet can then be de-activated when the pressure has decreased or has otherwise returned to acceptable levels, or after the passage of a pre-determined amount of time. The electromagnet can be activated by a user turning, for example, a switch or dial, or making a selection using a keyboard, mouse, or from a touchscreen display integral to the printer, or from a workstation in wired or wireless communication with the printer. In another embodiment, sediment formation is inhibited by the rotation of a magnet.

"Rotating a magnet" means to cause the magnet to spin such that the magnet's magnetic field stirs the particles in the ferrofluid within the ink tank thereby inhibiting or preventing sediment formation. The rotation of the magnet can be induced by an electric current, by a rotation of another magnet situated in close proximity thereto, a motor with a preferably non-metallic shaft attached to the magnet, or manually by a user. Rotation of the magnet can be initiated in response to the MICR inkjet printer having been turned OFF with the magnet's rotation ceasing or slowing down when the MICR inkjet printer is turned ON. The magnet's rotation can be initiated after the MICR inkjet printer has been idle for a pre-defined amount of time with the magnet's rotation ceasing (or reducing) at a point prior to the print job being run. The magnet's rotation can be initiated by a sensor signaling that sediment in the ink tank has reached a pre-determined level with the magnet's rotation ceasing (or reducing) after the level of sediment has been reduced or eliminated, or after the passage of a pre-determined amount of time. The magnet's rotation can be initiated by a sensor signaling that a flow-rate of liquid ink through the tank is at or below a threshold level of acceptability with the magnet's rotation ceasing (or reducing) after the flow rate has been increased or has otherwise returned to acceptable levels, or after the passage of a pre-determined amount of time. In those MICR inkjet printer where the MICR ink is propelled under pressure into the tank, the magnet's rotation can be initiated by a sensor signaling that a pressure inside the tank has reached or exceeded a threshold level of acceptability with the magnet's rotation ceasing (or slowing down) after the pressure has decreased or has otherwise returned to acceptable levels, or after the passage of a pre-determined amount of time. The magnet's rotation can be initiated by a user turning, for example, a switch or dial, or making a selection using a keyboard, mouse, or from a touchscreen display integral to the printer or from a workstation in wired or wireless communication with the print system. A controller can be used to dynamically adjust a speed of the magnet's rotation based on, for example, a flow-rate of liquid ink through the tank, an amount of sediment in the tank, and a pressure in the tank. The speed of the magnet's rotation can be reduced as a function of time. The rotatable magnet can be a permanent magnet or an electromagnet. The magnet can be Iron (Fe), Nickel (Ni), Boron (B), Cobalt (Co), Neodymium (Nd), Samarium (Sm), or a combination hereof. The magnet can have any shape such as, for instance, disc, cylindrical, square, ring, spherical, bar, helical, horseshoe, and arcuate. In one embodiment, the rotatable magnet resides in a chamber which is on, near, or inside the ink tank.

Figure 2:
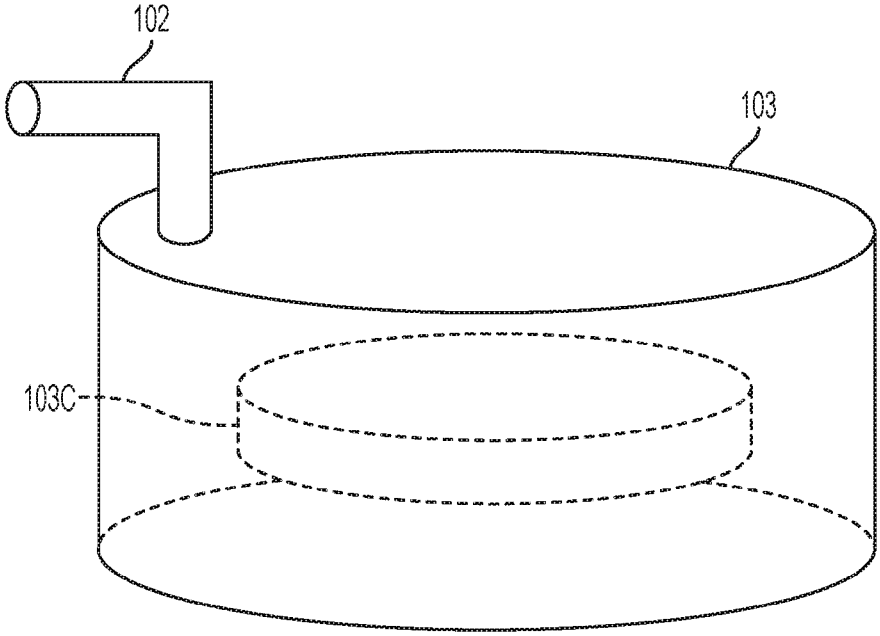
FIG. 2 shows one embodiment of a chamber.
Figure 3:
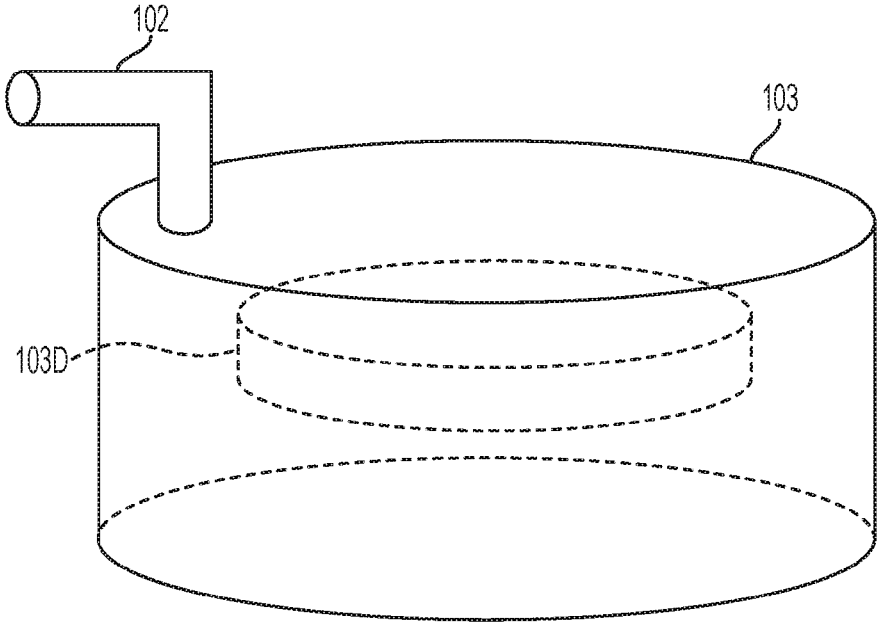
FIG. 3 shows one embodiment of a chamber.
Figure 4:
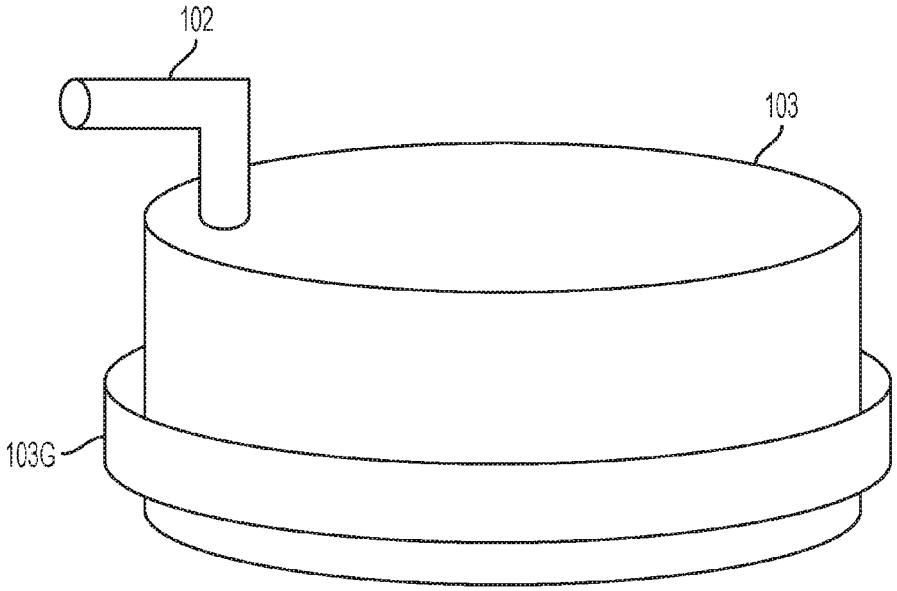
FIG. 4 shows one embodiment of a chamber.

A "chamber" is a place wherein the magnet resides. The chamber is preferably sealed such that the MICR ink does not come into contact with the magnet itself. In FIG. 2, chamber 103C is located at or below a top of the inside of the sub-tank. The chamber may take up all or a portion of an inside area of the sub-tank. In FIG. 3, chamber 103D is located centrally to an inside the sub-tank. Chamber 103D may be smaller, the same size, or larger than the top of the sub-tank. In FIG. 2F, chamber 103F is located around an interior wall of the sub-tank. Chamber 103F may be the same size or less than the inner dimensions of the sub-tank. In FIG. 4, chamber 103G is located around an outside wall of the sub-tank. Chamber 103G may be smaller, the same size, or larger than the outer dimensions of the sub-tank. Although the chambers of FIGS. 2, 3 and 4 are shown as being hollow, the chamber need not be hollow and may contain substances such as, for example, an aqueous solution or a solid. As such, the scope of the appended claims should not be viewed as being limited strictly to hollow chambers.

A "sensor" refers to an analog or digital sensing device which sends a signal in response to what is being sensed. In one embodiment, the sensor is designed to sense a flow-rate of liquid ink flowing through the sub-tank and generate an output signal when the flow-rate falls below a pre-defined threshold level. The output signal may be proportional to the flow-rate sensed. In another embodiment, the sensor is designed to sense pressure and generate an output signal when the pressure falls below a pre-defined threshold level. The output signal may be proportional to the pressure sensed. In yet another embodiment, the sensor is designed to sense sediment levels and generate an output when the level of sediment meets or exceeds a pre-defined threshold level. The output signal may be proportional to the level of the sediment. A sensor can be placed on, near, or through a wall of the feed-line to sense, for example, flow-rate and/or pressure. The sensor can be placed on, near, or through a sidewall of the sub-tank. The sensor can be placed on, near, or through a floor of the tank. The sensor may be placed on, near, or through a wall of the main tank (not shown). The sensor may be in wired or wireless communication with another device which performs the desired sensing. The sensor is used to activate/de-activate an electromagnet or to induce the rotatable magnet to start/stop spinning. This sensor may be placed in communication with a controller.

A "controller", as is generally understood in the electrical arts, receives an input and, as a result of that input, initiates an action which controls another device or mechanism. Although shown as boxes, any of the controllers can be a circuit, ASIC, a special purpose module, a processor, or the like. The controller receives a signal and, in various embodiments, induces a magnet to start/stop spinning or activates/de-activates an electromagnet. Any of the controllers hereof may control a speed of the magnet's rotation based on flow-rate, pressure, and sediment level.

Various Embodiments

The sensor can sense pressure and/or flow-rate in feed-line 102 and, in response thereto, signals a controller to activate/de-activate the electromagnet. The controller can also be placed in communication with other sensors depending on the implementation.

Figure 5:
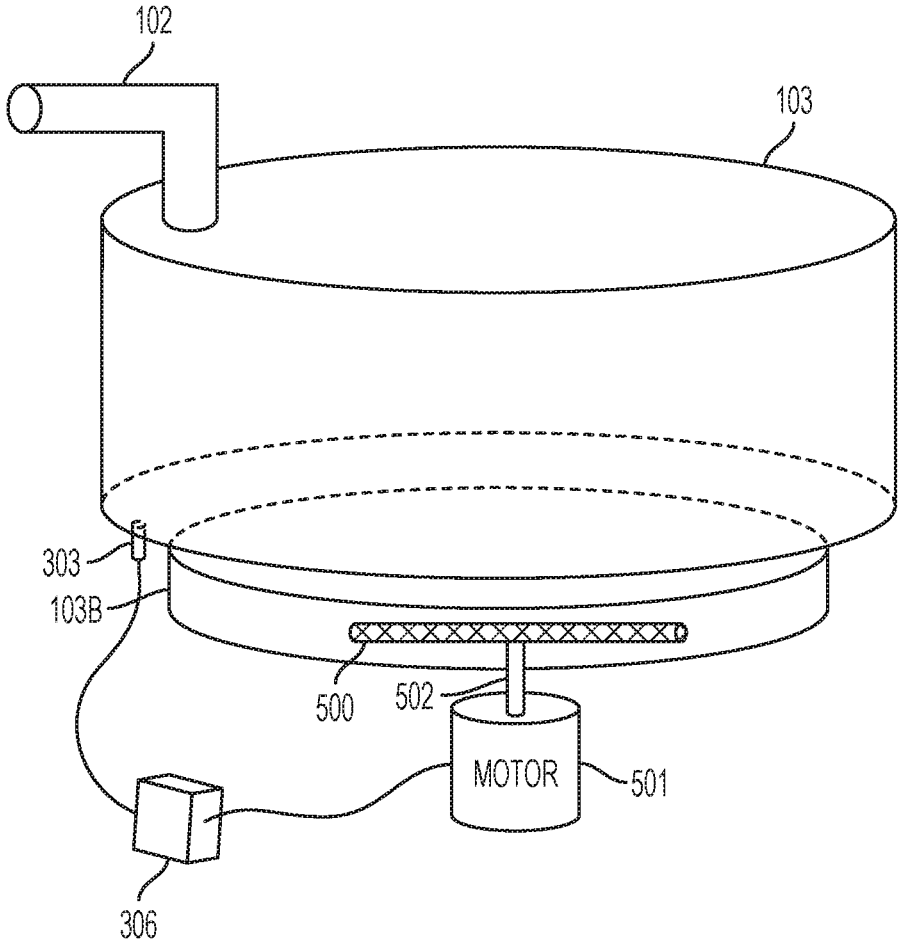
FIG. 5 shows a chamber located beneath a bottom of the outside of the sub-tank houses a cylindrical permanent magnet connected to a small motor via a rotatable shaft.

Reference is now being made to FIG. 5 which shows a combination of the embodiments of FIG. 2B and various components of FIG. 3. Chamber 103B below a bottom of the sub-tank, houses rotatable magnet 500. Sensor 303 senses a level of the sediment at the bottom of the sub-tank and, in response thereto, signals controller 306 to induce a rotation in the magnet 500 shown connected to motor 501 via a rotatable shaft 502. The controller of FIG. 5 can be placed in communication with sensors 301 and/or 302, depending on the implementation.

Figure 6:
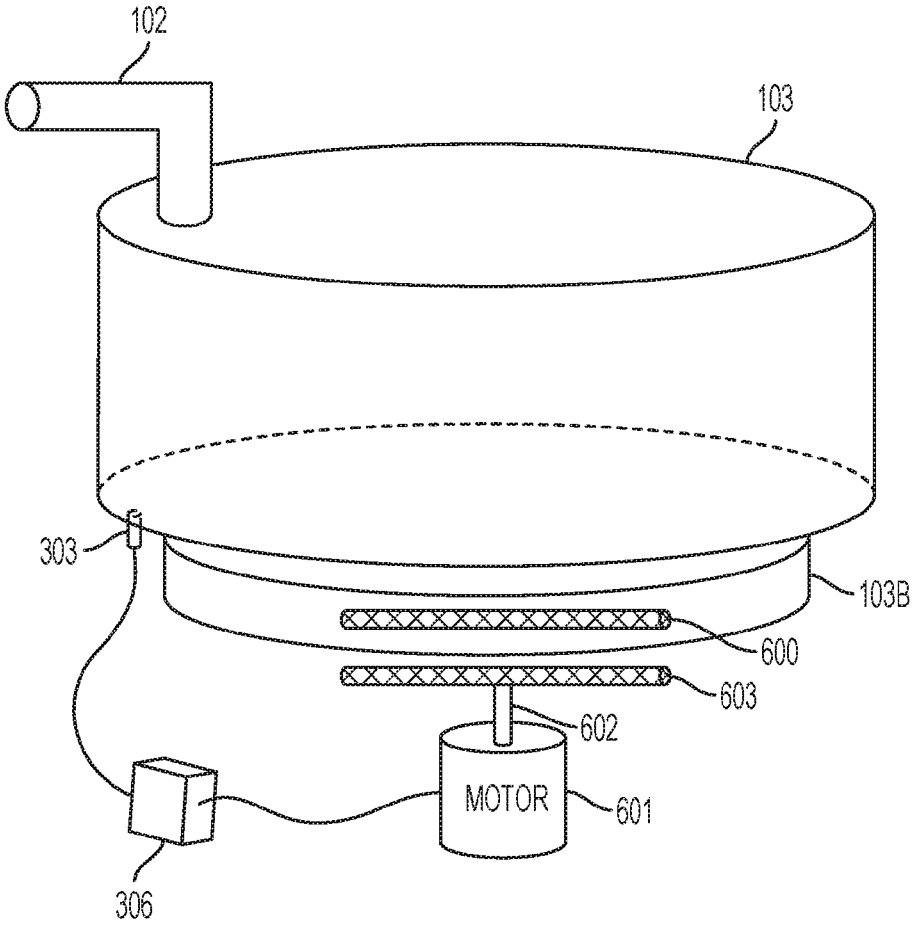
FIG. 6 shows a chamber located beneath a bottom of the outside of the sub-tank houses a cylindrical permanent magnet which, in turn, is induced to rotate by encountering the magnetic field of another rotating magnet connected to a small motor via a rotatable shaft.

Reference is now being made to FIG. 6 which shows yet another embodiment wherein a rotation is induce into the magnet by the rotation of another magnet spinning in proximity thereto. In this embodiment, chamber 103B below a bottom of the sub-tank, houses a rotatable magnet 600. Sensor 303 senses a level of the sediment at the bottom of the sub-tank and, in response thereto, signals controller 306 to induce a rotation in the magnet 600. Motor 601 rotates a non-metallic shaft 602 to rotate a first magnet 603 which induces a rotation in the magnet 600 housed inside chamber 103B. Rotation is induced by the chambered magnet 600 encountering the magnetic field of the spinning magnet 603. The controller of FIG. 6 can be placed in communication with other sensors, depending on the implementation.

It should be understood that the sensors, controllers, motors of any of the figures hereof are individually or collectively connected to a power source (not shown) via connections not shown.

Block Diagram of Special Purpose Computer

Figure 7:
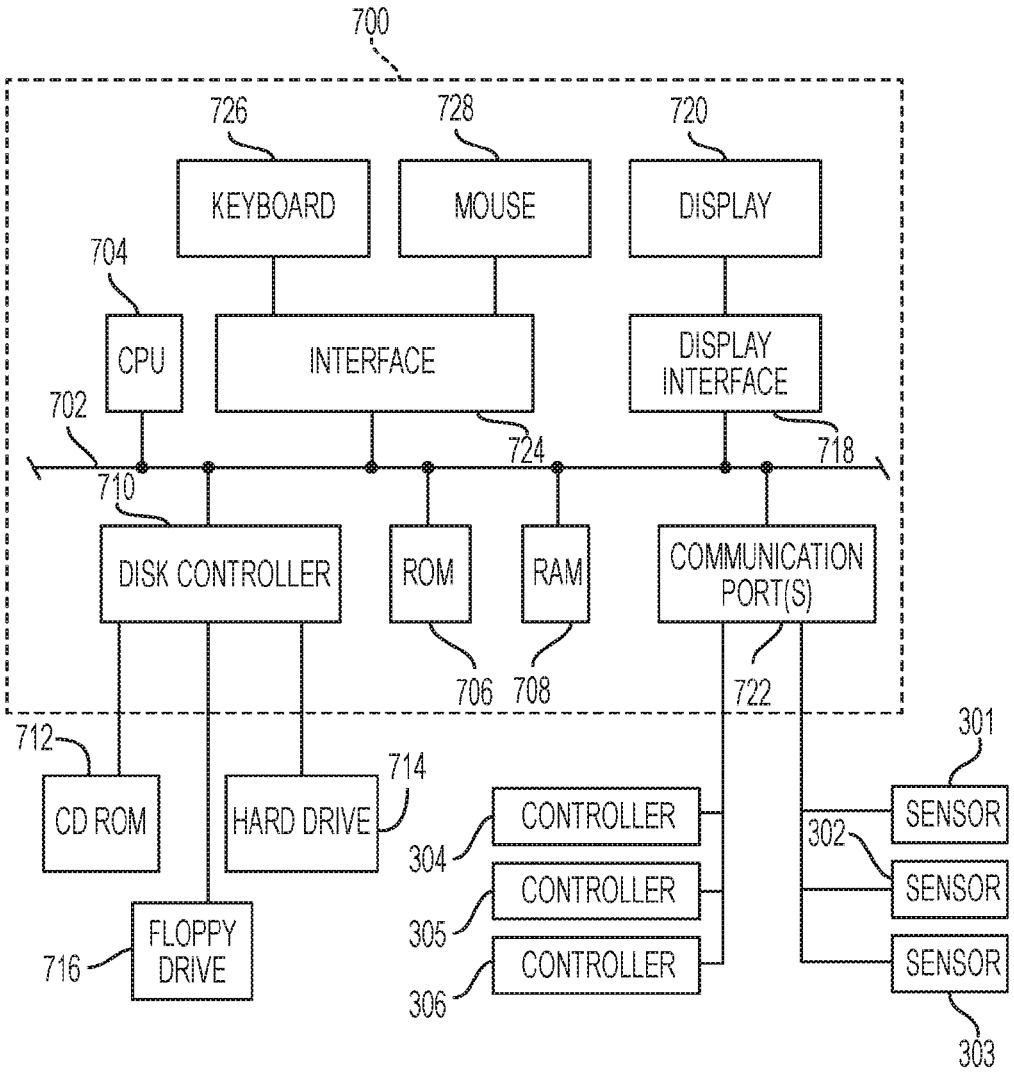
FIG. 7 illustrates a block diagram of one example special purpose computer for implementing various aspects hereof discussed with respect to the variously described embodiments.

Reference is now being made to FIG. 7 which illustrates a block diagram of one example special purpose computer for implementing various aspects hereof discussed with respect to the variously described embodiments. Such a special purpose computer is capable of executing machine executable program instructions for facilitating the performance of any of the sensors and controllers hereof, as well as to enable a user interaction therewith. Such a special purpose computer may comprise any of a micro-processor, micro-controller, ASIC, electronic circuit, or any combination thereof.

In FIG. 7, communications bus 702 is in communication with a central processing unit (CPU) 704 capable of executing machine readable program instructions for performing any of the calculations, comparisons, logical operations, and other program instructions for performing any of the steps described above with respect to the flow diagrams and illustrated embodiments hereof. Processor 704 is in communication with memory (ROM) 706 and memory (RAM) 708 which, collectively, constitute example storage devices. Such memory may be used to store machine readable program instructions and other program data and results to sufficient to carry out any of the functionality described herein. Disk controller 710 interfaces with one or more storage devices 714 which may comprise external memory, zip drives, flash memory, USB drives, or other devices such as CD-ROM drive 712 and floppy drive 716. Storage device stores machine executable program instructions for executing the teachings hereof. Such storage devices may be used to implement a database wherein various records are stored containing, for example, device specific flow-rates, device-specific pressure ranges, desired sediment levels, and the like.

Display interface 718 effectuates the display of information on display 720 in various formats such as, for instance, audio, graphic, text, and the like. Interface 724 effectuates a communication via keyboard 726 and mouse 728, collectively a graphical user interface. Such a graphical user interface is useful for a user to enter information as needed or to make a selection in accordance with various embodiments disclosed herein. Communication with external devices may occur using example communication port(s) 722. Shown is communication port(s) 722 being placed in communication with the sensors 301, 302 and 303 and controllers 304, 305 and 306 to effectuate the teachings hereof. Such ports may be placed in communication with devices over networks (not shown) such as, for example, the Internet or an intranet, either by wired or wireless links. Example communication ports include modems, network cards such as an Ethernet card, routers, a PCMCIA slot and card, USB ports, and the like, capable of transferring data from one device to another. Software and data is transferred via the communication ports which may be any of digital, analog, electromagnetic, optical, infrared, or other signals capable of being transmitted and/or received by the communications interface. Such signals may be implemented using, for example, a wire, cable, fiber optic, phone line, cellular link, RF, or other signal transmission means presently known in the arts or which have been subsequently developed.

The teachings hereof can be implemented using any known or later developed systems, structures, devices, and/ or software by those skilled in the applicable art without undue experimentation from the functional description provided herein with a general knowledge of the relevant arts. The teachings hereof may be partially or fully implemented in software using object or object-oriented software development environments that provide portable source code that can be used on a variety of computer, workstation, server, network, or other hardware platforms. One or more of the capabilities hereof can be emulated in a virtual environment as provided by an operating system, specialized programs or leverage off-the-shelf computer graphics software such as that in Windows, Java, or from a server or hardware accelerator or other image processing devices.

One or more aspects of this disclosure are intended to be incorporated in an article of manufacture such as an inkjet printer capable of rendering MICR characters onto a media substrate. The article of manufacture may be included as part of a larger system which may be shipped, sold, leased, or otherwise provided separately either alone or as part of an add-on, update, upgrade, or product suite.

It will be appreciated that various of the above-disclosed and other features and functions, or alternatives thereof, may be combined into other systems, devices, or applications. Various presently unforeseen or unanticipated alternatives, modifications, variations, or improvements therein may become apparent and/or subsequently made by those skilled in the art which are also intended to be encompassed by the following claims. Accordingly, the embodiments set forth above are considered to be illustrative and not limiting. Various changes to the above-described embodiments may be made without departing from the spirit and scope of the invention.

The teachings of any printed publications including patents and patent applications, are each separately hereby incorporated by reference in their entirety.

What is claimed is:

1. A method for inhibiting sediment from forming in an ink tank of a Magnetic Ink Character Recognition (MICR) inkjet printer, the method comprising:

disposing at least one sealed chamber inside an ink tank;

a magnet disposed inside said sealed chamber; and activating an electromagnet of said ink tank containing an aqueous solution of liquid MICR ink substantially comprising a ferrofluid of particles thereby rotating said magnet to stir at least a portion of said particles in said ink tank to inhibit sediment formation, and said particles being attracted to said electromagnet's magnetic field such that at least a portion of said particles are lifted off a bottom of said ink tank to inhibit sediment formation thereon, and whereby said sealed chamber prevents said liquid MICR ink from contacting said magnet.

2. The method of claim 1, wherein said electromagnet resides in a chamber located at one of: near a floor inside said ink tank, central to an interior of said ink tank, near a top of an inside of said ink tank, above the top of an outside of said ink tank, around an inside wall of said ink tank, and around an outside wall of said ink tank.

3. The method of claim 1, wherein said electromagnet is activated in response to any of: said MICR inkjet printer having been turned OFF, said MICR inkjet printer having been idle for a pre-defined amount of time, an amount of sediment in said ink tank having reached a pre-determined level, a flow-rate of ink through said ink tank having fallen below a threshold level, a pressure inside said ink tank having risen above a threshold level, and a user input.

4. An apparatus for inhibiting sediment from forming in an ink tank of a Magnetic Ink Character Recognition (MICR) inkjet printer, the apparatus comprising:

an ink tank containing an aqueous solution of liquid MICR ink substantially comprising a ferrofluid of particles;

at least one sealed chamber disposed inside said ink tank;

a rotatable magnet residing in said sealed chamber, whereby said sealed chamber prevents said liquid MICR ink from contacting said rotatable magnet; and an electromagnet, activation of said electromagnet causing a rotation of said magnet causing said magnet's field lines to stir at least a portion of said particles in said ink tank and said particles to be attracted to said electromagnet's magnetic field such that at least a portion of said particles are lifted off a bottom of said ink tank to inhibit sediment formation thereon.

5. The apparatus of claim 4, wherein said electromagnet resides in a chamber located at one of: near a floor inside said ink tank, central to an interior of said ink tank, near a top of an inside of said ink tank, above the top of an outside of said ink tank, around an inside wall of said ink tank, and around an outside wall of said ink tank.

6. The apparatus of claim 4, wherein said electromagnet is activated in response to any of: said MICR inkjet printer having been turned OFF, said MICR inkjet printer having been idle for a pre-defined amount of time, an amount of sediment in said ink tank having reached a pre-determined level, a flow-rate of liquid ink through said ink tank having fallen below a threshold level, a pressure inside said ink tank having risen above a threshold level, and a user input.

7. The apparatus of claim 4, further comprising a sensor which activates said electromagnet in response to any of: an amount of sediment in said ink tank having reached a pre-determined level, a flow-rate of ink through said ink tank having fallen below a threshold level, and a pressure inside said ink tank having risen above a threshold level.

8. A method for inhibiting sediment from forming in an ink tank of a Magnetic Ink Character Recognition (MICR) inkjet printer, the method comprising:

disposing at least one sealed chamber inside an ink tank; and rotating a magnet residing in said sealed chamber of an ink tank of a MICR inkjet printer, said ink tank containing an aqueous solution of liquid MICR ink substantially comprising a ferrofluid of particles, a rotation of said magnet's field lines stirring at least a portion of said particles in said ink tank to inhibit sediment formation, and whereby said sealed chamber prevents said liquid MICR ink from contacting said magnet.

9. The method of claim 8, wherein said sealed chamber is located at one of: near a floor inside said ink tank, central to an interior of said ink tank, near a top of an inside of said ink tank, and around an inside wall of said ink tank.

10. The method of claim 8, wherein said rotation is initiated in response to any of: said MICR inkjet printer having been turned OFF, said MICR inkjet printer having been idle for a pre-defined amount of time, an amount of sediment in said ink tank having reached a pre-determined level, a flow-rate of ink through said ink tank having fallen below a threshold level, a pressure inside said ink tank having risen above a threshold level, and a user input.

11. The method of claim 8, wherein said rotation is induced by one of: an electric current, a rotation of another magnet, a motor, a motor with a shaft, and manually by a user.

12. The method of claim 8, wherein a speed of rotation is based on one of: a flow-rate of liquid ink through said ink tank, a pressure inside said ink tank, a level of sediment in said ink tank, and a manual adjustment by a user.

13. An apparatus for inhibiting sediment from forming in an ink tank of a Magnetic Ink Character Recognition (MICR) inkjet printer, the apparatus comprising:

an ink tank containing an aqueous solution of liquid MICR ink substantially comprising a ferrofluid of particles;

at least one sealed chamber disposed inside said ink tank; and a rotatable magnet residing in said sealed chamber, whereby said sealed chamber prevents said liquid MICR ink from contacting said rotatable magnet, a rotation of said magnet causing said magnet's field lines to stir at least a portion of said particles in said ink tank to inhibit sediment formation.

14. The apparatus of claim 13, wherein said sealed chamber is located at one of: near a floor inside said ink tank, central to an interior of said ink tank, near a top of an inside of said ink tank, and, around an inside wall of said ink tank.

15. The apparatus of claim 13, wherein said rotation is initiated in response to any of: said MICR inkjet printer having been turned OFF, said MICR inkjet printer having been idle for a pre-defined amount of time, an amount of sediment in said ink tank having reached a pre-determined level, a flow-rate of ink through said ink tank having fallen below a threshold, and a pressure inside said ink tank having risen above a threshold.

16. The apparatus of claim 13, further comprising a sensor which initiates a rotation of said magnet in response to any of: sediment in said ink tank having reached a pre-determined level, a flow-rate of liquid ink through said ink tank having fallen below a threshold, and a pressure inside said ink tank having risen above a threshold.

17. The apparatus of claim 13, further comprising a controller for controlling a speed of said magnet's rotation.

18. The apparatus of claim 13, wherein a speed of rotation is based on any of: a flow-rate of liquid ink through said ink tank, a pressure inside said ink tank, a level of sediment in said ink tank, and a manual adjustment by a user.

19. The method of claim 1, wherein said sealed chamber includes a second aqueous solution different from said aqueous solution.

20. The apparatus of claim 4, wherein said sealed chamber includes a second aqueous solution different from said aqueous solution.

21. The method of claim 8, wherein said sealed chamber includes a second aqueous solution different from said aqueous solution.

22. The apparatus of claim 13, wherein said sealed chamber includes a second aqueous solution different from said aqueous solution.

* * * * *